United States Patent [19]

Ohmura

[11] 4,437,571

[45] Mar. 20, 1984

[54] THIN SHEET SORTING APPARATUS

[75] Inventor: Hideo Ohmura, Tokyo, Japan

[73] Assignee: Tokyo Shibaura Denki Kabushiki Kaisha, Japan

[21] Appl. No.: 309,846

[22] Filed: Oct. 8, 1981

[30] Foreign Application Priority Data

Oct. 13, 1980 [JP] Japan ..... 55-14193

[51] Int. Cl.[3] ..... B07C 5/344

[52] U.S. Cl. ..... 209/551; 209/534; 209/548

[58] Field of Search ..... 209/534, 546, 548, 549, 209/551, 603, 604, 605

[56] References Cited

U.S. PATENT DOCUMENTS

| | | | |
|---|---|---|---|
| 2,827,167 | 3/1958 | Joseph et al. | 209/534 |
| 2,950,799 | 8/1960 | Timms | 209/534 X |
| 3,710,936 | 1/1973 | Mizunuma | 209/551 X |
| 3,759,382 | 9/1973 | Walkley et al. | 209/534 |
| 4,025,420 | 5/1977 | Horino | 209/534 |
| 4,166,030 | 8/1979 | Lewis et al. | 209/534 |
| 4,334,619 | 6/1982 | Horino et al. | 209/551 |

FOREIGN PATENT DOCUMENTS

| | | |
|---|---|---|
| 2749641 | 5/1978 | Fed. Rep. of Germany . |
| 1488133 | 10/1977 | United Kingdom . |
| 2034286 | 6/1980 | United Kingdom . |
| 2038290 | 7/1980 | United Kingdom . |
| 2056415 | 3/1981 | United Kingdom . |

*Primary Examiner*—Robert B. Reeves
*Assistant Examiner*—Edward M. Wacyra
*Attorney, Agent, or Firm*—Cushman, Darby and Cushman

[57] ABSTRACT

An apparatus for processing paper sheets, in which one lot of paper sheets are set in a supply section and supplied one after another to an inspection station which makes optical, magnetic and mechanical inspections for sorting the sheets into at least three categories of sheets, i.e. valid, damaged, uncountable, and directs the valid sheets to a collection receptacle and the damaged and uncountable sheets to another collection receptacle. Each collection receptacle is provided with a counter and the sum of the counters is compared with the number of sheets in one lot. If the comparison results are correct, a subsequent lot is fed from the supply section to be processed. Once an uncountable sheet has been inspected, the counter of the collection receptacle receiving the damaged and uncountable sheets is inhibited and the total number of sheets contained in this collection receptacle must be input by an operator through a keyboard to perform the comparison step.

9 Claims, 3 Drawing Figures

THIN SHEET SORTING APPARATUS

BACKGROUND OF THE INVENTION

This invention relates to a thin sheet sorting apparatus for automatically inspecting thin sheets, such as slips, checks, securities, etc., to classify them into a first group of sheets, e.g. available sheet group, and a second group of sheets, e.g. unavailable sheet group.

There have recently been developed and put to practical use various thin sheet sorting apparatus which automatically inspect thin sheets such as securities and classify them into first and second sheet groups. In the sorting apparatus of this type, the sheets are automatically counted one by one to be checked for overs and shorts. Moreover, unavailable sheets, such as different sheets, invalid sheets, etc., which cannot be inspected by an inspection device are rejected, and available or valid sheets are classified into two groups, soiled sheets (valid but unfit for reusing) and normal sheets (fit for reusing). Then, these classified groups of sheets are tied up in bundles of 100 sheets, and sealed.

In the aforesaid thin sheet sorting apparatus, the number of checked sheets is verified when an operator keys in the number of rejected sheets after a given number of sheets, e.g. 100 sheets, are checked. Before the checking, those sheets, such as forged securities or superposed sheets, which cannot be inspected by the inspection device are collectively allotted as rejectable sheets to a rejection pocket.

With such prior art apparatus, however, the operator must key in the number of rejected sheets with the operation of the apparatus stopped after processing of each 100 sheets. Thus, the non-working time of the apparatus is increased to reduce the processing capability thereof by a large margin and to reduce the labor-saving effect.

SUMMARY OF THE INVENTION

The object of this invention is to provide a thin sheet sorting apparatus capable of reducing the number of the operator's key-in operations for the number of rejected sheets.

According to this invention, individual sheets included in a bundle of sheets supplied from a sheet supply section to a sheet transfer section are fed one by one into a sheet inspection device. The sheet inspection device makes necessary inspections of the sheet, and the sheet is allotted to a valid sheet section, or a rejected sheet section in accordance with the results of such inspections. When sheets delivered to the rejected sheet section are countable ones they are counted automatically, and the excess or deficiency of the sheets is detected on the basis of the counted value obtained thereby and the count value for the valid sheets.

DETAILED DESCRIPTION OF THE PREFERRED EMBODIMENT

Figure 1:
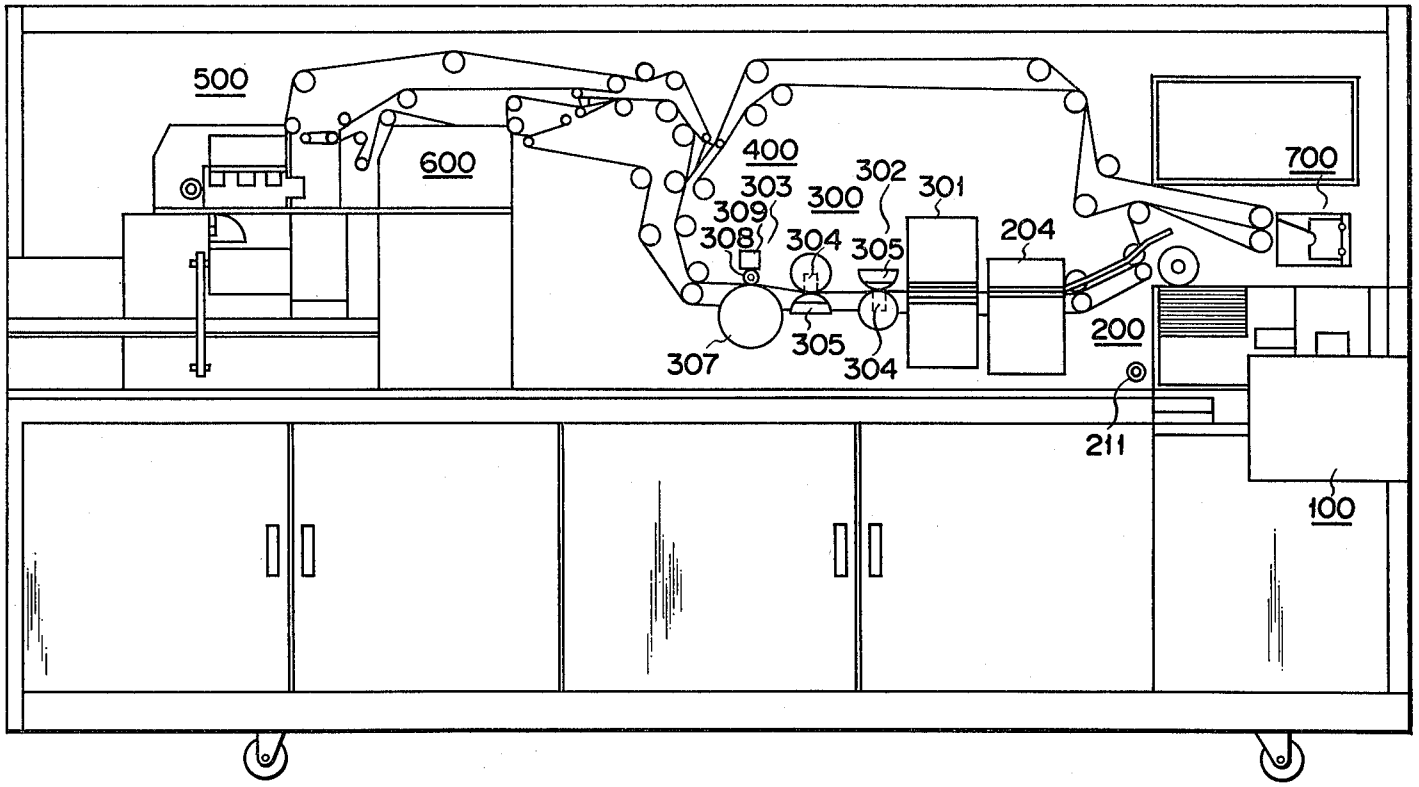
FIG. 1 is a front view of a thin sheet sorting apparatus according to an embodiment of this invention.

In a thin sheet sorting apparatus shown in FIG. 1, a sheet supply device 100 is so designed as to supply a sheet transfer device 200 with bundles of sheets. The sheet transfer device 200 transfers the sheets one by one to a sheet inspection device 300 by way of a cleaner 204. The sheet transfer device 200 is provided with a sheet kind setting dial 211 which is intended to adjust the position of an adjuster in a sheet cassette (not shown) in accordance with the width of sheets being handled. For example, three kinds of sheets can be set by means of the dial 211. Communicating with a vacuum device (not shown), the cleaner 204 is so designed as to attract and remove dust on each sheet transferred thereto. The sheet passed through the sheet inspection device 300 is transferred to a sheet sorting device 400, which allots the sheet to a valid sheet tray 500, a soiled sheet tray 600, or a rejected sheet tray 700 in accordance with the results of inspections by the sheet inspection device 300.

The sheet inspection device 300 is composed of an optical inspector 301, a magnetic inspector 302, and a mechanical inspector 303. The optical inspector 301 applies e.g. a visible light to the sheet P being transferred, converts a reflected light from and a transmitted light through the sheet P into electric signals, and detects the optical characteristics of the sheet on the basis of the electric signals. The magnetic inspector 302 has two magnetic heads 304 and 304 for detecting the magnetic characteristics of the sheet. The sheet is pressed against these magnetic heads 304 and 304 by pressure pads 305 and 305. The mechanical inspector 303, which has a function to detect the thickness of the sheet, includes a reference roller 307 fixed so as not to shift its circumferential position and a rocking roller 308 capable of rocking relatively to the reference roller 307. When the sheet is sandwiched between the rocking roller 308 and the reference roller 307, the rocking roller 308 is displaced in accordance with the thickness of the sheet, and such displacement is optically detected by a detector 309.

Figure 2:
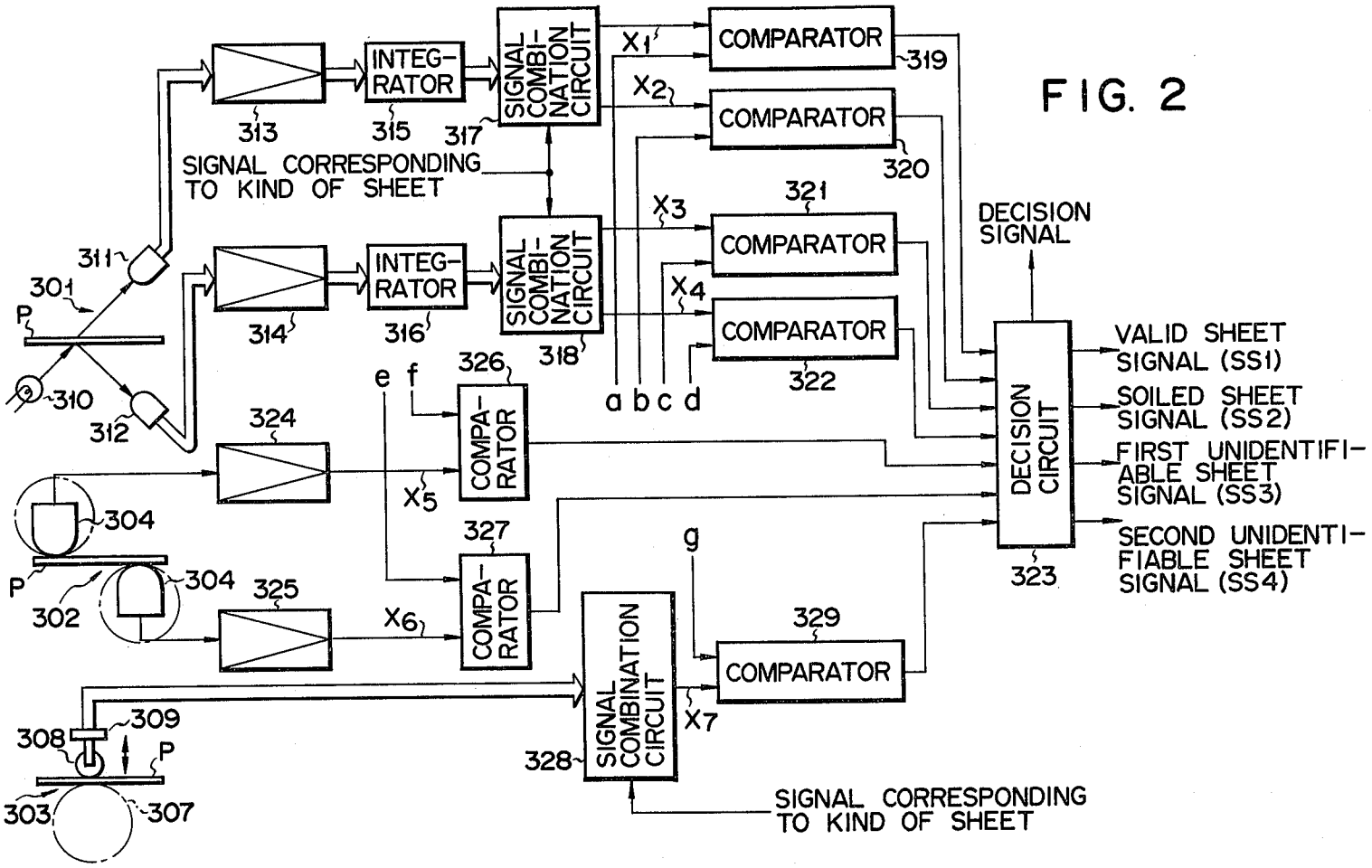
FIGS. 2 and 3 are circuit diagrams of a sheet inspection device of the thin sheet sorting apparatus of FIG. 1.

Referring now to the circuit diagram of FIG. 2, there will be described in detail the sheet inspection device 300. The optical inspector 301 is composed of a light source 310 for applying light to the sheet, a photosensor 312 to receive reflected light from the sheet, and a photosensor 311 to receive light transmitted through the sheet. Each of the photosensors 311 and 312 is formed of a plurality of photoelectronic elements arranged correspondingly to the regions of the sheet whose optical characteristics are to be detected. The output terminals of the photosensors 311 and 312 are connected to the input terminals of integrators 315 and 316 through amplifiers 313 and 314, respectively. The output terminal of the integrators 315 and 316 are connected to one input terminals of signal combination circuits 317 and 318, respectively. The other input terminals of the signal combination circuits 317 and 318 are connected with a sheet kind setting signal source (not shown). X1- and X2-signal output terminals of the signal combination circuit 317 are connected to one input terminal of each of comparators 319 and 320, respectively, while, X3- and X4-signal output terminals of the signal combination circuit 318 are connected to one input terminal of each of comparators 321 and 322, respectively. The other input terminals of the comparators 319 to 322 are connected with signal sources for reference signals a, b, c and d, respectively. The output terminals of the comparators 319 to 322 are connected to their corresponding input terminals of a decision circuit 323.

The output terminals of the magnetic heads 304 and 304 of the magnetic inspector 302 are connected to input terminals of comparators 326 and 327 through amplifiers 324 and 325, respectively. The other input terminals of the comparators 326 and 327 are connected with signal sources for reference signals e and f, respectively. The output terminals of the comparators 326 and 327 are connected to their corresponding input terminals of the decision circuit 323.

Figure 3:
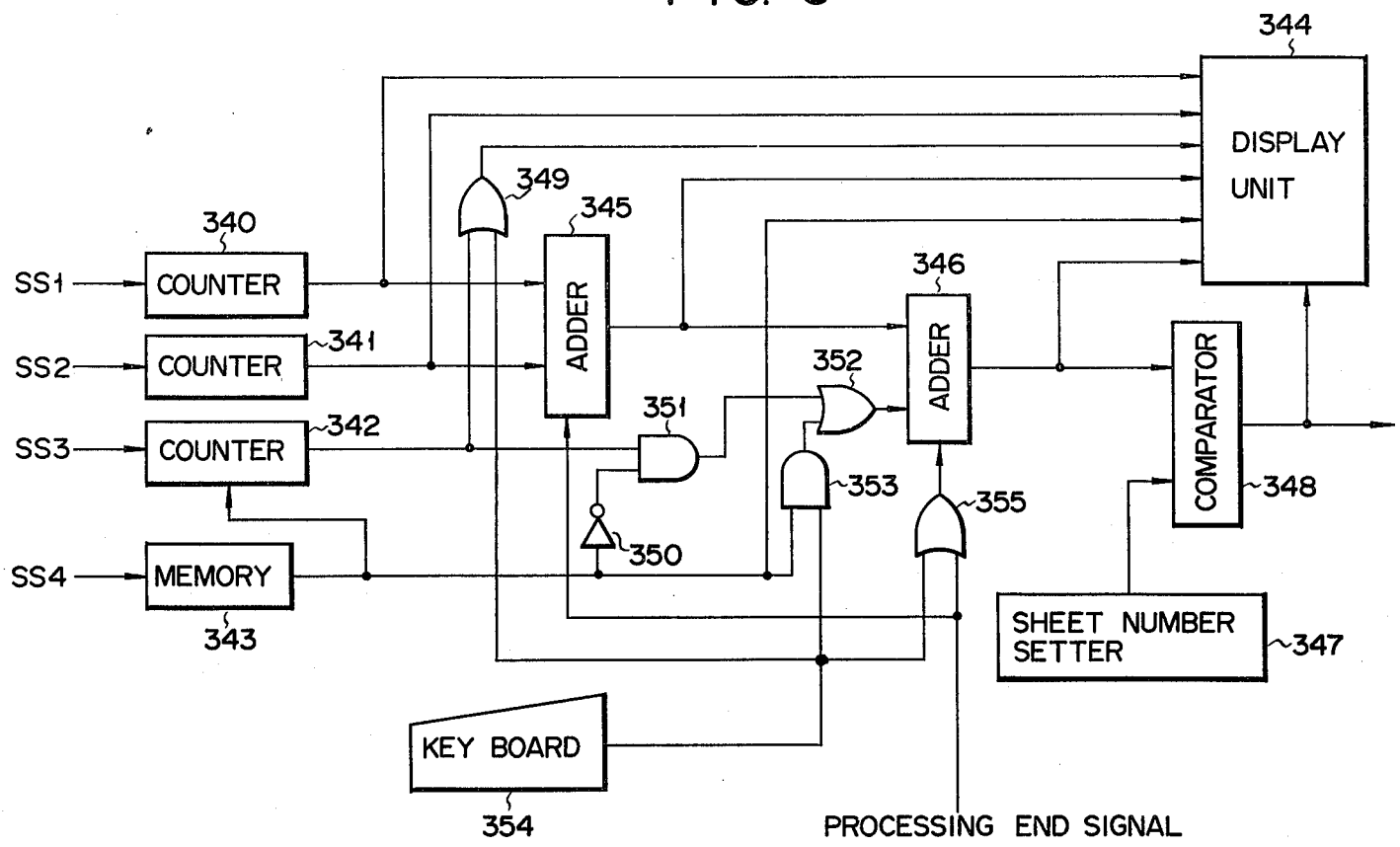

The output terminal of the mechanical inspector 303 is connected to one input terminal of a signal combination circuit 328. The other input terminal of the signal combination circuit 328 is connected with the sheet kind setting signal source, while its output terminal is connected to one input terminal of a comparator 329. The other input terminal of the comparator 329 is connected with a reference signal (g) source, while its output terminal is connected to its corresponding input terminal of the decision circuit 323. The valid sheet signal output terminal, soiled sheet signal output terminal, first unidentifiable sheet signal output terminal, and second unidentifiable sheet signal output terminal of the decision circuit 323 are connected to the input terminals of counters 340, 341 and 342 and a memory 343 shown in FIG. 3, respectively. The first unidentifiable sheets are ones capable of counting one by one, such as invalid sheet, different sheet etc. and second unidentifiable sheets are ones incapable of counting, such as superposed sheets, folded sheets, paper-backed sheet, i.e. sheet backed with paper, etc. The output terminals of the valid and soiled sheet counters 340 and 341 are connected to their corresponding input terminals of a display unit 344 and an adder 345. The output terminal of the adder 345 is connected to its corresponding input terminals of the display unit 344 and the adder 346. The output terminal of the adder 346 is connected to its corresponding input terminal of the display unit 344 and one input terminal of a comparator 348. The other input terminal of the comparator 348 is connected with a sheet number setter 347. The output terminal of the invalid sheet counter 342 is connected to one input terminals of an OR gate 349 and an AND gate 351. The output terminal of the second unidentifiable sheet memory 343 is connected to the input terminal of an inverter 350, one input terminal of an AND gate 353, and its corresponding input terminal of the display unit 344. The output terminal of the inverter 350 is connected to the other input terminal of the AND gate 351. The output terminal of a keyboard 354 is connected to the respective other input terminals of the OR gate 349 and the AND gate 353 and one input terminal of an OR gate 355. A processing end signal source (not shown) is connected to the reset terminal of the adder 345 and the other input terminal of the OR gate 355. The output terminal of the OR gate 355 is connected to the reset terminal of the adder 346.

When e.g. bundles of 100 sheets are supplied to the sheet supply device 100 of the above-mentioned thin sheet sorting apparatus and the sheet kind setting dial 211 is set for the kind of the supplied sheets to start the apparatus, one of the bundles of sheets in the sheet supply device 100 are fed into the sheet transfer device 200. The sheet transfer device 200 transfers the sheets one by one to the sheet inspection device 300 by way of the cleaner 204. When the sheet is carried into the optical inspector 301, the optical inspector 301 detects the optical characteristics of the sheet. Optical characteristic signals corresponding to optical characteristics delivered from the photosensors 311 and 312 of the optical inspector 301 are amplified to their respective predetermined levels by the amplifiers 313 and 314, respectively, and applied to the integrators 315 and 316, respectively. The integrators 315 and 316 severally integrate the optical characteristic signals, and apply integration outputs to the signal combination circuits 317 and 318, respectively. The signal combination circuit 317 combines integration signals corresponding to the optical characteristic signals from the photosensor 311 which severally correspond to a plurality of regions of the sheet in accordance with sheet kind setting signals corresponding to the kind of the sheet, thereby detecting the degree of soiling or optical soiling degree and the optical genuineness of the sheet, and producing a soiling degree analog signal X1 and a genuineness decision analog signal X2. Likewise, the signal combination circuit 318 produces a soiling degree signal X3 and a genuineness decision signal X4 based on the reflected light. These signals X1 to X4 are supplied to the comparators 319 to 322 to be compared with the reference signals a to d, respectively. These reference signals a to d are analog reference signals based on the transmitted light through and reflected light from a normal sheet of the set kind. The comparators 319 to 322 produce output signals corresponding to the results of comparison of the input signals X1 to X4 with the reference signals a to d, and these output signals are applied to the decision circuit 323.

Subsequently, when the sheet is fed into the magnetic inspector 302, the magnetic heads 304 and 304 of the magnetic inspector 302 detect the magnetic characteristics of the top and under surfaces of the sheet, respectively. The output signals of the magnetic heads 304 and 304 are amplified by the amplifiers 324 and 325, and applied as magnetic characteristic signals X5 and X6 to the comparators 326 and 327, respectively. The comparators 326 and 327 compare the magnetic characteristic signals X5 and X6 for the top and under surfaces respectively with the reference signals f and e, and apply the results of such comparison to the decision circuit 323.

The mechanical inspector 303 produces displacement signals corresponding to the displacement of the rocking roller 308 which shifts its position in accordance with the thickness of the sheet. The signal combination circuit 328 combines the displacement signals in accordance with the sheet kind setting signal, and produces an analog signal corresponding to the thickness of the sheet, that is, a thickness analog signal X7. In this case, the signal combination circuit 328 delivers the signal X7 representing the thickness characteristic of superposed, folded, torn, skewed or paper-backed sheets by combining the displacement signals. The thickness analog signal X7 is applied to the comparator 329 to be compared with the reference signal g. The comparator 329 produces a comparison result signal corresponding to the thickness analog signal X7, and applies the result signal to the decision circuit 323.

The decision circuit 323 discriminates between valid sheets, soiled sheets, first unidentifiable sheets, and second unidentifiable sheets in accordance with signals from the comparators 319 to 322 and 326, 327 and 329 on the basis of the conditions shown in the table below. In the table, b1, d1, e1, f1 and g1 represent the allowable upper limits of the reference signals b, d, e, f and g while b2, d2, d2, f2 and g2 represent the allowable lower limits thereof. Namely, the reference signal b has an allowable range of b1 to b2. Likewise, the reference signals d, e, f and g have allowable ranges of d1 to d2, e1 to e2, f1 to f2, and g1 to g2, respectively.

TABLE

| DECISION PRIORITY | SHEET CLASSIFICATION | | CONDITIONS TO BE SATISFIED |
|---|---|---|---|
| 1 | SHEETS TO BE REJECTED | FIRST UNIDENTIFIABLE SHEET | $X2 > b2$, OR $b1 > X2$, OR $X4 > d2$, OR $d1 > X4$, OR $X5 > e2$, OR $X5 < e1$, OR $X6 > f2$, or $X6 < f1$ |
| | | SECOND UNIDENTIFIABLE SHEET | $X7 > g2$, OR $X7 < g1$ |
| 2 | SOILED SHEET | | $b1 \leqq X2 \leqq b2$, AND $d1 \leqq X4 \leqq d2$, AND $e1 \leqq X5 \leqq e2$, AND $f1 \leqq X6 \leqq f2$, AND $g1 \leqq X7 \leqq g2$, FURTHER $X1 < a$ OR $X3 < c$ |
| 3 | NORMAL SHEET | | $X1 \geqq a$, AND $b1 \leqq X2 \leqq b2$, AND $X3 \geqq c$, AND $d1 \leqq X4 \leqq d2$, AND $e1 \leqq X5 \leqq e2$, AND $f1 \leqq X6 \leqq f2$, AND $g1 \leqq X7 \leqq g2$ |

On the basis of the table above, the decision circuit 323 produces a decision result signal corresponding to the results of the decision or discrimination, that is, valid sheet signal (SS1), soiled sheet signal (SS2), first unidentifiable sheet signal (SS3), or second unidentifiable sheet signal (SS4). The decision result signal is transmitted to the sheet sorting device 400, where it is used for the classification of discriminated sheet. The sheet signal, also, is applied to the corresponding one of the counters 340 to 342 or the memory 343. The counters 340 to 342 count valid sheets, soiled sheets, and unidentifiable sheets, respectively. The memory 343 stores the presence or absence of second unidentifiable sheet. The contents of the counters 340 to 342 and the memory 343 are indicated on the display unit 344. When sorting of one bundle of sheets is ended, a processing end signal is produced, and the adder 345 adds the count values in the counters 340 and 341 in response to the processing end signal. The sum of the count values obtained by the addition is indicated on the display unit 344. If neither first unidentifiable sheets nor second unidentifiable sheets are found in decision, the contents of the first unidentifiable sheet counter 342 and the second unidentifiable sheet memory 343 are 0, so that the adder 345 produces an addition result of 100. The addition result or sum 100 from the adder 346 is directly applied to the comparator 348 to be compared with the set value (100). The comparator 348 supplies the sheet supply device 100 with a signal indicating the coincidence of the input value and the set value. In response to the output signal of the comparator 348, the sheet supply device 100 supplies the sheet transfer device 200 with a subsequent bundle of sheets. If any first unidentifiable sheets are found in decision, the count value in the first unidentifiable sheet counter 342 is transferred through the OR gate 349 to the display unit 344 to be indicated thereon. When processing of a bundle is ended, the adder 345 adds the contents of the counters 340 and 341 in response to the processing end signal, and applies the result of such addition to the adder 346. Supplied with the count value in the first unidentifiable sheet counter 342 through the AND gate 351 and the OR gate 352, the adder 346 adds the addition value in the adder 345 and the count value in the counter 342. The addition value in the adder 346 is the sum total of the numbers of valid sheets, soiled sheets, and first unidentifiable sheets, coming to 100. Thereupon, the comparator 348 supplies the sheet supply device 100 with the signal indicating the coincidence of the input value and the set value, thereby causing the sheet supply device 100 to supply the sheet transfer device 200 with another bundle of sheets. Thus, where valid sheets, soiled sheets, and first unidentifiable sheets are exist, the number of sheets of the supplied bundle is automatically collated with the sum total of the sorted sheets, and the bundles of sheets are processed successively.

If the second unidentifiable sheets e.g. superposed sheets are found in decision, the second unidentifiable sheet memory 343 stores information indicating the presence of the superposed sheets, e.g. binary "1". In this case, the unidentifiable sheet counter 342 is cleared by the output "1" of the memory 343. The AND gate 351 is closed by an inverted signal from the inverter 350, while the AND gate 353 is opened by the memory output "1". The occurrence of the second unidentifiable sheet is indicated on the display unit 344. After processing of one bundle of sheets is ended, valid and soiled sheets are stored in the trays 500 and 600, respectively, and first and second unidentifiable sheets are stored in the rejected sheet tray 700. Then, the first and second unidentifiable sheets are taken out of the rejected sheet tray 700, and counted, for example, manually. Inputted by means of the keyboard 354, the count value is indicated on the display unit 344 and applied to the adder 346 through the AND gate 353 and the OR gate 352. The adder 346 adds the addition value in the adder 345 or the sum of the numbers of the valid and soiled sheets and the input value for the keyboard 354. If the value obtained by such addition is 100, the comparator 348 produces a signal indicating the coincidence of the value in the adder 346 and the set value. When the coincidence is confirmed by the output signal of the comparator 348, an operator is expected to push a start button (not shown) of the thin sheet sorting apparatus to restart sorting.

According to this invention, as described above, if no auto-count difficult sheets, such as superposed sheets, folded sheet, paper-backed sheet, etc. are among the rejected sheets, the rejected sheets are counted automatically, the number of the rejected sheets is added to the sum of the valid and soiled sheets, and the value obtained by such addition is automatically collated with the set value. Unless there are auto-count difficult sheets, therefore; sheet sorting can be performed continuously, and the sorting apparatus can be improved in processing capability to relieve the operator's work load.

In this invention, securities or cards, such as checks, slips, etc. can be used as the sheets. In the above embodiment, moreover, the sheets are counted by counting the signals of the decision circuit by means of counters. Alternatively, however, the sheets may be counted when they are transferred to the trays for sorting by the sorting device 400.

What is claimed is:

1. A thin sheet sorting apparatus comprising:

sheet transfer means for transfering a first group of sheets including a given number of sheets one by one from a reservoir of unsorted sheets to a sheet transport path;

sheet inspection means, disposed along said sheet transport path, for inspecting the sheets transferred from said sheet transfer means, and discriminating among three classes of sheets including effective sheets, countable unidentifiable sheets, and uncountable unidentifiable sheets;

sheet allotting means, disposed along said sheet transport path and through said sheet inspection means, for allotting the effective sheets and a group of sheets including both of the countable and uncountable unidentifiable sheets, which were discriminated by said sheet inspection means, to an effective sheet section and a rejected sheet section, respectively;

counting means, connected to said inspection means for detecting whether there are no uncountable unidentifiable sheets and in response to such a determination, producing a no-uncountable sheet signal;

collation means, connected to said detecting means and said counting means, for collating the sum of the number of the effective sheets and the number of the countable unidentifiable sheets with a set number in response to a no-uncountable sheet signal from said detecting means and producing in response thereto a collation signal indicative of completion of the sorting of said first group of sheets from said reservoir; and sheet supplying means, connected to said collation means, for supplying a second group of sheets having said given number from said reservoir to said sheet transfer means in response to the collation signal from said collation means.

2. A thin sheet sorting apparatus according to claim 1, wherein said sheet inspection device includes at least one of an optical inspector for optical inspection of the sheets, a magnetic inspector for magnetic inspection and a mechanical inspector for mechanical inspection, and means for discriminating between the effective, countable unidentifiable, and uncountable unidentifiable sheets on the basis of the result of the inspection by at least one of said inspectors and reference values.

3. A thin sheet sorting apparatus according to claim 1, wherein said sheet inspection device includes means for making at least one of optical, magnetic, and mechanical inspections of the sheets transferred thereto and producing at least one of optical, magnetic, and mechanical inspection signals, comparing means for comparing the inspection signals from said inspection signal output means with their corresponding reference signals and producing comparison result signals, and a decision circuit for discriminating the sheets on the basis of the comparison result signals from said comparing means and producing effective sheet signals, countable unidentifiable signals and uncountable unidentifiable signals, and said counting means counts the effective sheet signals and the countable unidentifiable signals to obtain the number of the effective sheets and the number of the countable unidentifiable sheets.

4. A thin sheet sorting apparatus according to claim 1, wherein contents of said counting means are displayed on a display device.

5. A thin sheet sorting apparatus according to claim 1, wherein said effective sheets includes valid sheets and soiled sheets, said countable unidentifiable sheets includes invalid sheets and different sheets and said uncountable unidentifiable sheets include superposed sheets, folded sheets and paper-backed sheets.

6. A thin sheet sorting apparatus according to claim 1, wherein said detecting means comprises means for producing an uncountable sheet signal when uncountable unidentifiable sheets are inspected by said inspection means and wherein said collation means comprises means for collating the sum of the number of the effective sheets, the number of the countable unidentifiable sheets and a number of uncountable unidentifiable sheets which is keyed in by an operator, with said set number.

7. A thin sheet sorting apparatus comprising:

sheet transfer means for transferring a given number of sheets one by one;

a sheet inspection device for inspecting the sheets transferred one by one from said sheet transfer means, thereby deciding, at least, effective sheets, first unidentifiable sheets and second unidentifiable sheets;

a device for allotting the effective sheets and both of the first and second unidentifiable sheets to an effective sheet section and a rejected sheet section, respectively, according to the decision of said sheet inspection device;

means for counting the effective sheets and the first unidentifiable sheets allotted to said effective sheet section and rejected sheet section, respectively, to obtain the number of the effective sheets and the number of the first unidentifiable sheets;

input means for inputting the number of the first and second unidentifiable sheets allotted to said rejected sheet section when the sheet inspection device has decided that a second unidentifiable sheet has been inspected;

collation means for collating the sum of the number of the effective sheets and one of the number of the first unidentifiable sheets and the number of the sheets inputted to said input means with a set number and producing a collation signal in collation; and means for supplying said sheet transfer means with the given number of subsequent sheets in response to the collation signal from said collation means.

8. A thin sheet sorting apparatus according to claim 7, wherein a display device is provided to display the number of the effective sheets, the number of the first unidentifiable sheets and the number of the sheets inputted by the input means.

9. A thin sheet sorting apparatus according to claim 7 or 8, wherein said sheet inspection device includes means for making at least one of optical, magnetic, and mechanical inspections of the sheets transferred thereto and producing at least one of optical, magnetic, and mechanical inspection signals, comparing means for comparing the inspection signals from said inspection signal output means with their corresponding reference signals and producing comparison result signals, and a decision circuit for discriminating the sheets on the basis of the comparison result signals from said comparing means and producing effective sheet signals, first unidentifiable signals and second unidentifiable signals, and said counting means counts the effective sheet signals and the first unidentifiable signals to obtain the number of the effective sheets and the number of the first unidentifiable sheets.

* * * * *